US006557738B1

(12) United States Patent
Meintzer

(10) Patent No.: US 6,557,738 B1
(45) Date of Patent: May 6, 2003

(54) PAINT CAN CARRIER

(76) Inventor: Robert L Meintzer, 3899 W. Quail Dr., Douglasville, GA (US) 30135

( * ) Notice: Subject to any disclaimer, the term of this patent is extended or adjusted under 35 U.S.C. 154(b) by 0 days.

(21) Appl. No.: 09/815,217

(22) Filed: Mar. 22, 2001

(51) Int. Cl.[7] ..... A45F 5/00

(52) U.S. Cl. ..... 224/148.7; 224/197; 224/240; 224/242; 224/270; 224/272; 224/660; 224/677; 224/678

(58) Field of Search ..... 224/148.7, 219, 224/220, 660, 676, 677, 678, 679, 240, 242, 251, 270, 271, 272, 197

(56) References Cited

U.S. PATENT DOCUMENTS

| | | | | | |
|---|---|---|---|---|---|
| 1,109,161 | A | * | 9/1914 | Chindgren | 224/148.7 |
| 2,685,992 | A | | 8/1954 | Cornell | |
| 2,987,231 | A | * | 6/1961 | Lewis | 224/148.4 |
| 2,995,281 | A | | 8/1961 | Dixon | |
| 4,325,503 | A | | 4/1982 | Swinney | |
| 4,527,720 | A | * | 7/1985 | Hayes | 224/148.4 |
| 4,708,273 | A | * | 11/1987 | Grant | 220/741 |
| 5,016,791 | A | | 5/1991 | Burow | |
| 5,056,696 | A | * | 10/1991 | Lahr | 224/148.4 |
| 5,067,643 | A | * | 11/1991 | McKinney | 224/197 |
| 5,232,137 | A | * | 8/1993 | Devine | 222/175 |
| 5,285,940 | A | * | 2/1994 | Goulter | 224/148.7 |
| 5,358,161 | A | | 10/1994 | Perugini | |
| 5,489,051 | A | | 2/1996 | Robinson | |
| 5,490,618 | A | | 2/1996 | Davidson | |
| 5,497,921 | A | | 3/1996 | Dancyger et al. | |
| 5,511,705 | A | * | 4/1996 | Dreszer | 224/582 |
| 5,730,339 | A | | 3/1998 | Stolfo | |
| 6,006,966 | A | * | 12/1999 | Voisin, Jr. | 224/148.4 |
| 6,045,017 | A | * | 4/2000 | Connell | 224/148.4 |
| 6,213,363 | B1 | * | 4/2001 | Norberg | 224/185 |

* cited by examiner

*Primary Examiner*—Stephen K. Cronin
*Assistant Examiner*—Maerena W. Brevard
(74) *Attorney, Agent, or Firm*—Kim S. Manson

(57) ABSTRACT

The present invention is a new and improved paint can carrier adapted for attachment to he person of a painter to maintain a paint can in a vertical orientation. The paint carrier comprises a vertically elongated cradle that swivels from a swing arm on one axis and the swing arm further swivels about a quick release coupler on another axis, thereby allowing the paint can to be maintained in a substantially vertical orientation at all times without regard to position of the person of the painter

18 Claims, 6 Drawing Sheets

PAINT CAN CARRIER

TECHNICAL FIELD

The present invention relates generally to painting and, more specifically, to a paint can carrier that allows hands free control of a paint can and paint brush while permitting the painter free use of his hands.

BACKGROUND ART

Painters are frequently required to paint surfaces while adopting awkward and sometimes dangerous positions including painting while standing on an angled roof or while walking on scaffolding or a catwalk. The painter must constantly maintain the paint bucket in a vertical position to prevent spillage. Maintaining the paint can in a vertical position can also be especially difficult when ascending or descending ladders or when painting overhead. Spillage often occurs when the painter must use both hands to maintain his balance or to prevent himself from falling.

In an attempt to overcome these deficiencies and provide hands free control of paint containers, hip-mounted carriers have been proposed. Examples of such devices may be found by reference to U.S. Pat. No. 5,489,051 to Robinson, U.S. Pat. No. 5,490,618 to Davidson, and U.S. Pat. No. 4,325,503 to Swinney.

The '051 Painter's Pouch to Robinson requires paint to be poured from an original paint can into the pouch. The filled pouch must then be strapped onto the waist of the painter, greatly increases the potential for spillage of valuable product. If the pouch is filled after it has been strapped onto the painter, paint must be poured into the pouch at an awkward angle at the waist of the painter. Further, the pouch must be thoroughly cleaned of one paint before the pouch can be used with another color of paint.

The '051 device is difficult to manufacture, requiring multiple compartments for additional tools.

The '618 Paint Pail Carrier to Davidson utilizes multiple straps to secure the paint carrier to the body of the painter. The device requires not only a waist strap but a shoulder strap and a leg strap as well. The shoulder strap is required to support the weight of the paint while the leg strap is used to attach the carrier to the painter's leg. The multitude of straps reduces the ease of use of the Davidson carrier, and results in time consuming buckling and unbuckling in order to use the device. Further, attachment of the device to the leg of the painter reduces the painter's movement and agility due to the bulk of the carrier. Because the device is strapped to the leg of the painter, the device is subject to the motion of the painter's leg. The device is therefore susceptible to damage whenever the painter's leg encounters a ladder rung or scaffolding upright.

The '503 patent to Swinney depends on a narrow lip on the bottom of a paint can to secure the paint can to the Swinney device. This lip, however, can become damaged through normal use, reducing the security of the paint can to the Swinney device and resulting in the loss of potentially large amounts of paint due to spillage. The Swinney device is limited in its movement in relation to the body of the painter. Although the device will swing away from the wearer when he leans in the direction of the paint can, it does not prevent tilting of the can when the wearer leans forward or backward.

In light of the present invention, the aforementioned designs are deficient in that they (1) reduce the agility and movement of the painter, (2) rely on narrow, insubstantial curved areas to support the paint container, and/or (3) require time consuming straps and buckles in order to don or remove the carrier. Such devices are fixed to the body of the painter and cannot readily be moved out of the path of obstacles. A further deficiency requires the awkward transfer of product that increases the potential for spillage. Each of the aforementioned designs results in potential significant waste of time and product.

It is readily apparent that a new and improved paint carrier is needed that will provide strong structural support to maintain a paint can in a substantially vertical position even when the painter bends or stoops, that can be quickly repositioned out of the way of obstacles, that does not require the wasteful transfer of paint from one container to another. A new and improved paint container is needed that can be quickly donned and removed from the painter's person. A new and improved paint carrier that is easily manufactured without excessive numbers of parts is also needed. It is, therefore, to the provision of such an improvement that the present invention is directed.

BRIEF SUMMARY OF THE INVENTION

Briefly described, in a preferred embodiment, the present invention overcomes the above-mentioned disadvantages by providing an easily mountable, easily detachable paint carrier that maintains a paint container in a vertical orientation without regard to the position of the body of the painter. The present invention allows the painter to paint with his hands free, even while assuming difficult non-vertical positions that are often required in order to paint awkward areas.

It is contemplated that the invention will be used with standard paint cans such as those in which paint is normally purchased from a supplier. Of course, paint may be purchased in bulk in large containers than can be conveniently carried on the job, and transferred to standard cans of convenient size.

It is regarded as prudent by painters, when starting to use a new can of paint, to set aside a portion of the paint until no more than one-half of a gallon remains in the paint can so as to reduce the probability of waste whether the painter is using a carrier device or is holding a can in his hand. The same prudent procedure may be followed when using this invention, but experience has shown there is no greater tendency for accidental spillage with this invention than when painting while holding the paint can.

The present invention, in the preferred embodiment, comprises a generally cylindrical cradle dimensioned to hold a one gallon paint container, an arcuate swing arm from which the cradle swivels, a waist belt and a quick release coupling that allows the cradle to readily rotate to keep the cradle and the paint container upright. The present invention incorporates a distance from the painter's body which isolates the movement of the carrier from the movement of the body. The swivel movement of the carrier provided by the quick release coupling works in conjunction with the swivel movement provided by the swing arm to allow the paint cradle to swing on more than axis so that the cradle remains upright at all times without regard to the position of the person. The quick release coupling also allows the cradle and swing arm to be readily attached and detached from the waist of the painter for convenience.

The cradle comprises a generally cylindrical shaped member having an upper section adapted for swivel communication with the swing arm, a lower section with a horizontally disposed base for supporting a paint cradle in a fixed position on the base, and a middle section therebetween comprising an upright member having a strap for firmly fitting around the paint can to secure the can to the middle section upright member. The upper section extends outwardly from the middle section upright member to comprise an arcuate member for securing the paint can within the cradle. Conveniently, the upper section may also be provided with a retractable clip for holding a paint brush above the paint in the cradle.

The swing arm is pivotally attached to the upper section arcuate member so as to urge swivel movement of the paint cradle. The quick release coupling comprises a male plug and a female connector which is fixedly attached to the waist strap. The male plug is fixedly attached to the swing arm. The waist strap is employed for firm attachment to the person's waist. The waist strap further comprises the female connector. The female connector is releasably pivotally attached to the male plug to provide additional swivel movement of the paint cradle.

The paint carrier is located at the waistline of the painter, placing it within the visual perception of the painter at all times. The belt allows the painter to easily shift the carrier to the rear or to the front of his body in order to move the carrier out of the way of any obstacles such as a ladder or scaffolding.

The present invention provides a novel and economically advantageous solution to longstanding problems faced by those in the painting industry by providing means to accomplish the more difficult painting tasks with greater ease and efficiency. The simple design permits the cradle to swing freely to maintain the paint can in an upright vertical position, without regard for the positioning of the body of the painter.

In an alternate embodiment, an adaptor for a quart size paint can is bolted to the base of the cradle. The middle section strap secures the quart size can to the middle section of the cradle.

A feature and advantage of the present invention is to provide a new and improved paint can carrier that maintains an open paint can in a vertical orientation without regard to the position of the body of the painter.

Another feature and advantage of the present invention is provide a new and improved paint can carrier which may be quickly and easily attached and detached from the painter's body.

Another feature and advantage of the present invention is provide a new and improved paint can carrier which may be quickly moved around the waist of the painter, out of the way of obstacles.

Another feature and advantage of the present invention is to provide a new and improved paint can carrier which may be easily manufactured.

Yet another feature and advantage of the present invention is provide a new and improved paint can carrier which may be produced at a low cost of manufacture with regard to materials and labor, thereby making the paint can carrier economically available to the buying public.

Still another feature and advantage of the present invention is to provide a new and improved paint can carrier which may be adapted to hold a smaller size can of paint.

These and other objects, features and advantages of the invention will become more apparent to one skilled in the art from the following description and claims when read in light of the accompanying drawings.

DETAILED DESCRIPTION OF THE PREFERRED AND ALTERNATE EMBODIMENTS

In describing the preferred embodiment of the present invention as illustrated in the figures, specific terminology is employed for the sake of clarity. The invention, however, is not intended to be limited to the specific terminology so selected, and it is to be understood that each specific element includes all technical equivalents that operate in a similar manner to accomplish similar functions.

With regard to all such embodiments as may be herein described and contemplated, it will be appreciated that optional features, including, but not limited to, aesthetically pleasing coloration and surface design, and labeling and brand marking, may be provided in association with the present invention, all without departing from the scope of the invention.

The present invention, a new and improved paint can carrier 10, allows a painter to have hands free control of the paint can and paint brush as he climbs ladders or paints hard to reach areas. Without such an invention, the painter must climb a ladder using one hand to climb while the other hand is used to hold the can of paint. This invention increases the safety of the painter since it allows the painter to climb or descend a ladder using both hands to hold the ladder. For hard to reach areas, the painter must balance and stabilize his body with only one hand while attempting to maintain the paint can in a vertical position at all times. The use of paint can carrier 10 provides hands free control of the paint can, maintaining the paint can in a vertical position at all times while allowing the painter to use both hands to prevent falls or to reach difficult areas.

Figure 1:
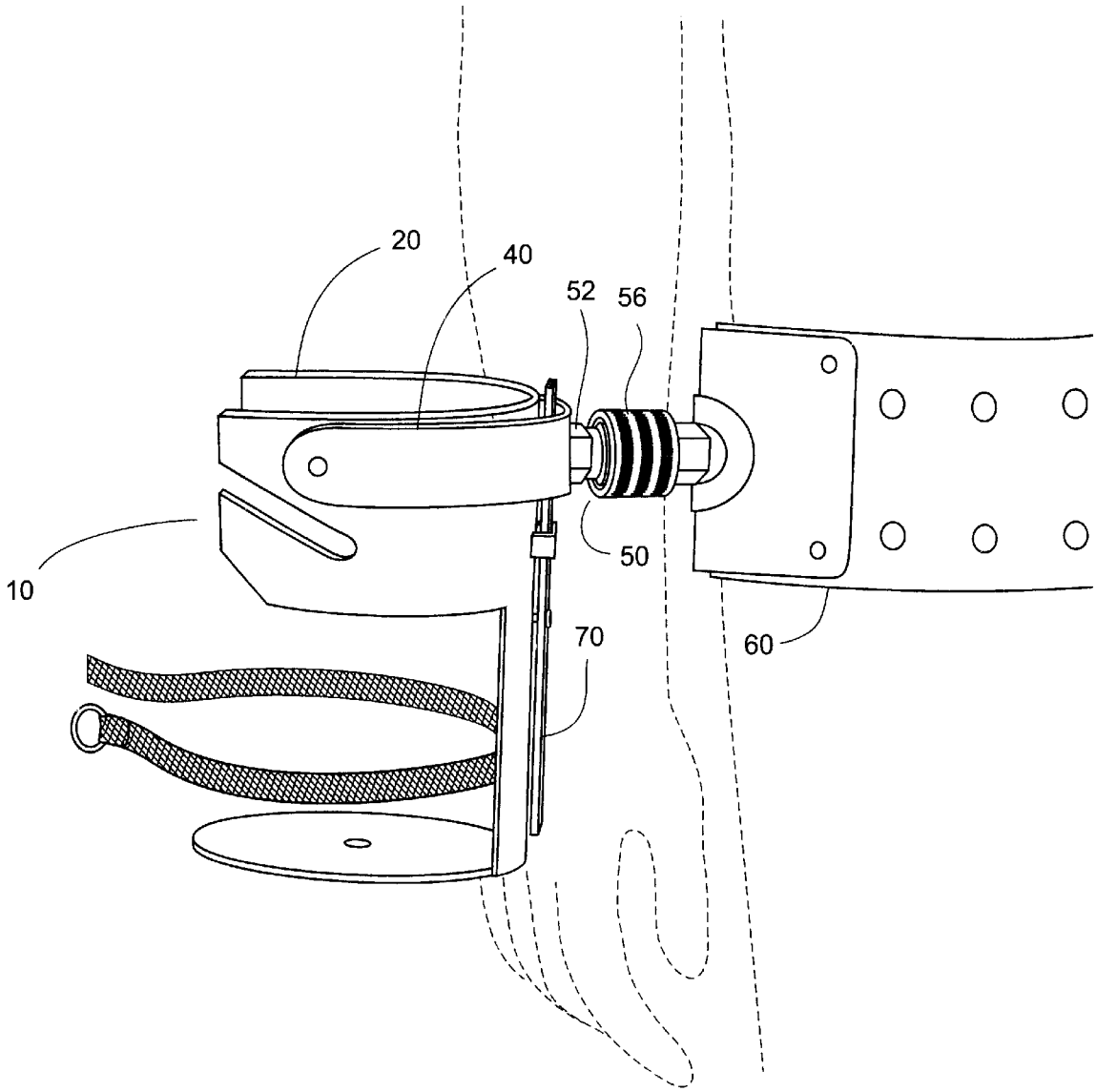
FIG. 1 is a perspective view of the present invention according to a preferred embodiment.
Figure 2:
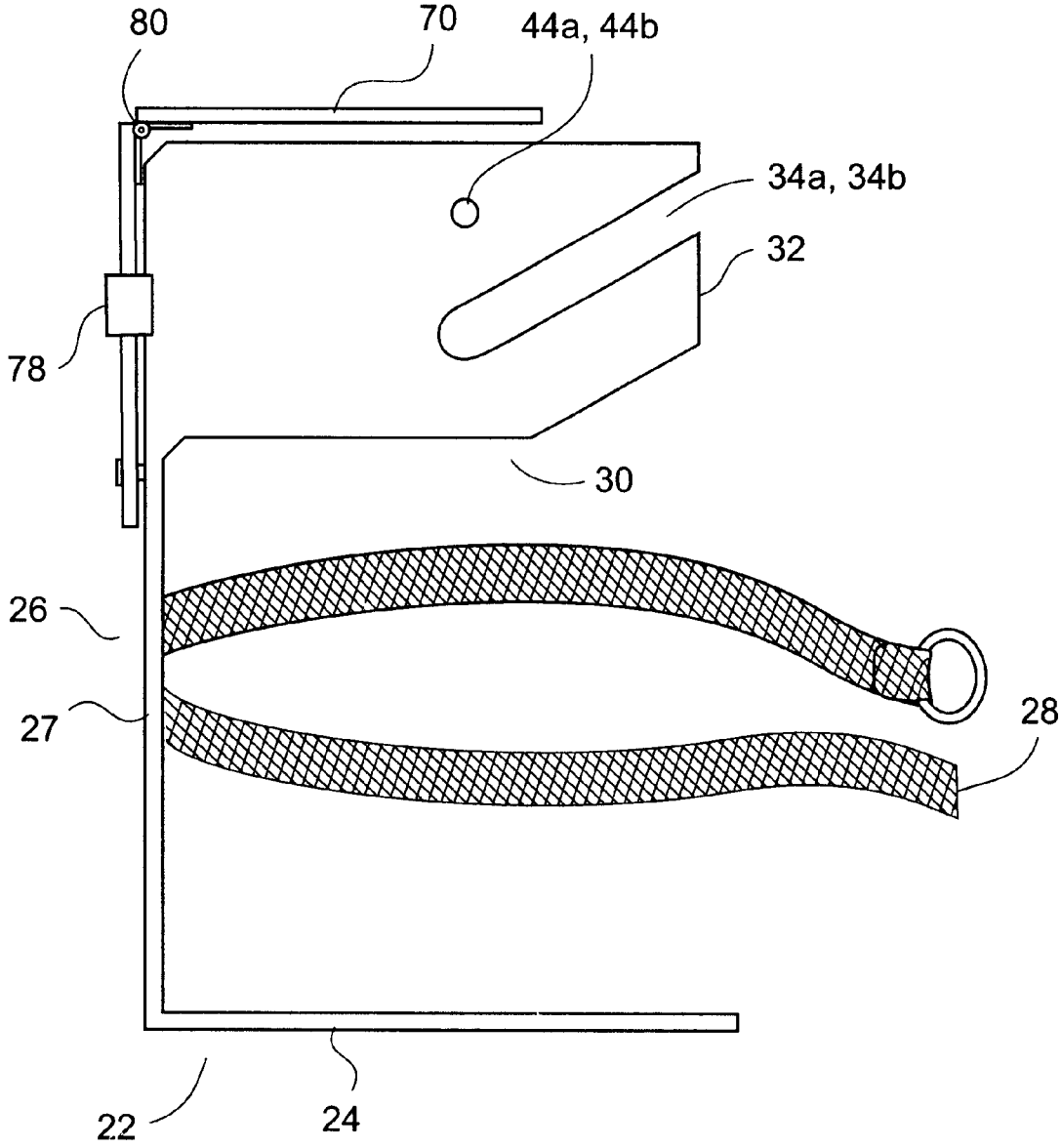
FIG. 2 is a side elevational view of the present invention according to a preferred embodiment.

Referring now to FIGS. 1 and 2, paint can carrier 10 generally comprises cradle 20, swing arm 40, quick release coupling 50 and waist belt 60. More specifically, cradle 20 comprises lower section 22 with horizontally disposed base 24, middle section 26 with elongated member 27 upwardly disposed from base 24 and upper section 30 with arcuate member 32 horizontally disposed from elongated member 27. Swing arm 40 is in swivel communication with arcuate member 32 to urge the paint can to remain upright at all times. Quick release coupling 50 connects swing arm 40 to waist belt 60 and provides swivel movement in a different axis from that provided by cradle 20 and swing arm 40. Quick release coupling 50 also provides the convenient ability to quickly attach and release cradle 20 from waist belt 60.

Figure 3:
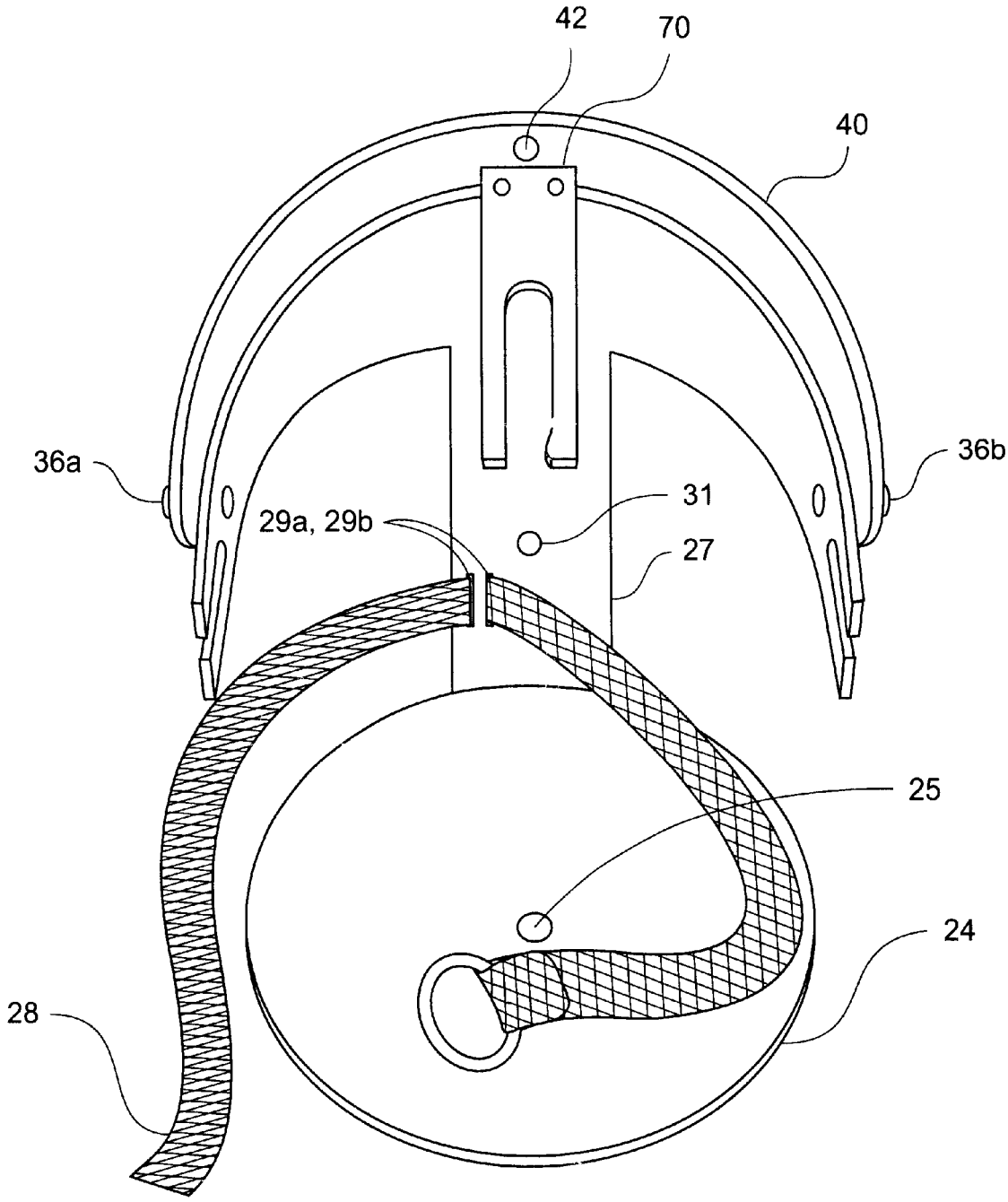
FIG. 3 is a front perspective view of the present invention according to a preferred embodiment.

Referring generally to FIG. 1 and FIG. 3, base 24 comprises a circular shaped horizontally disposed member fixedly attached to elongated member 27 by bending or any known means within the art. Base 24 further has aperture 25 threadedly adapted to receive bolt 100 from quart adaptor as more fully described below.

Figure 4:
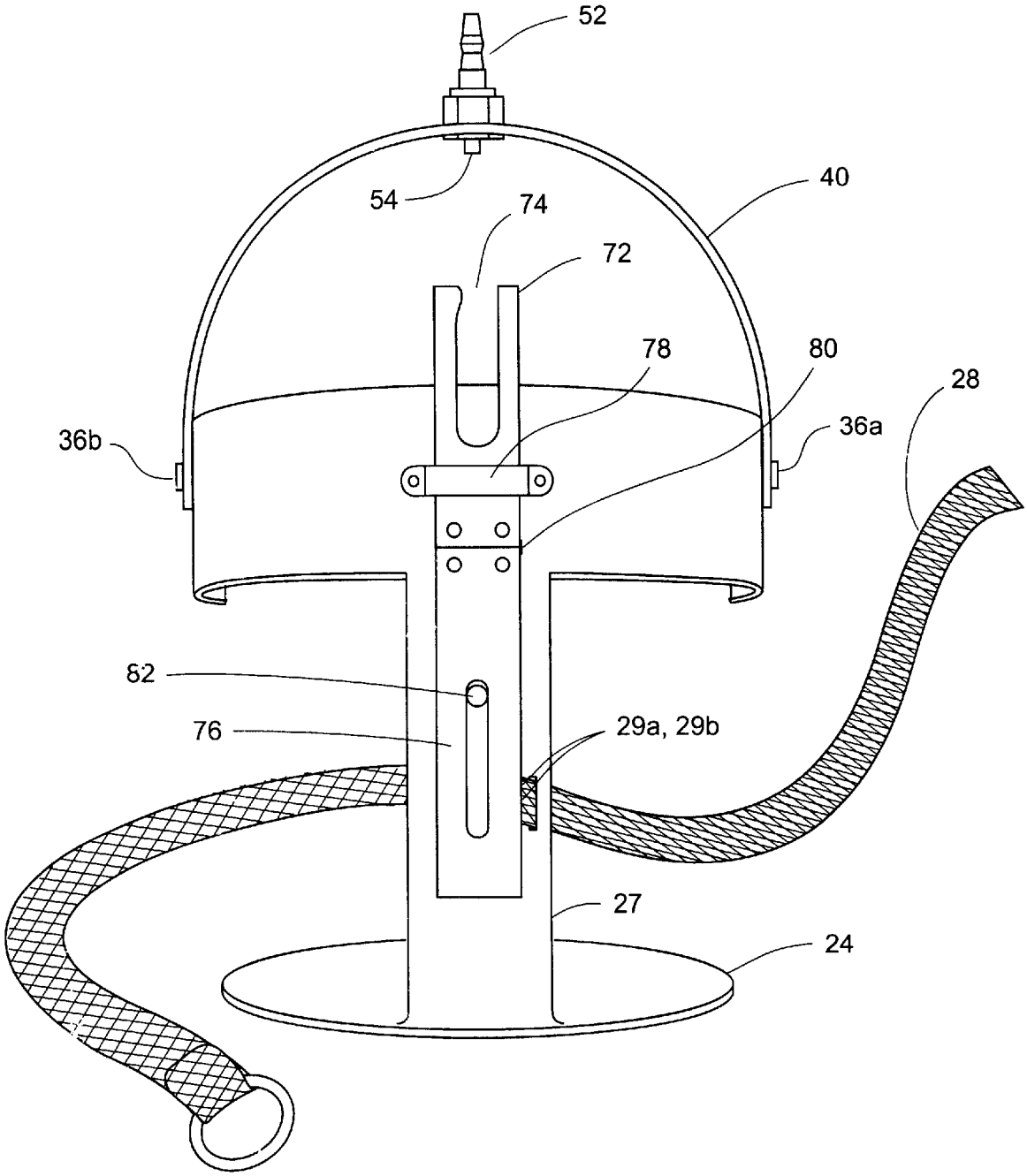
FIG. 4 is a rear elevational view of the present invention according to a preferred embodiment.

Middle section 26 comprises vertically oriented elongated upright member 27 fixedly attached to base 24. As shown in FIGS. 3 and 4, upright member 27 further has a plurality of parallel slots 29*a*, 29*b* adapted to receive strap 28. Strap 28 is slideably attached to upright member 27 and is adapted to be fastened around a paint can to hold it tightly against cradle 20 by conventional fastening means such as buckle. Upright member 27 further has aperture 31 adapted to receive dowel 82 for brush holder 70 as more fully described below. Dowel 82 is fixedly attached to upright member 27 and extends through aperture 31 to outer surface of upright member 27.

Upper section 30 of cradle 20 is designed to accommodate a one gallon paint can. The paint can is inserted through opening and rests on base 24. As shown in FIG. 1 and FIG. 2, downwardly angled slots 34*a*, 34*b* are adapted to receive knoblike handle supports on the wire handle of a paint can. Strap 28 is fastened around paint can to hold it tightly against middle section 26 of cradle 20. Cradle 20 is preferably constructed of a plastic such as PVC which would allow arcuate member 32 of upper section 30 to flexibly receive the paint can but rigid enough to provide structural integrity necessary to hold about a quart to a quart and a half of paint along with the paint can.

Upper section 30 further comprises apertures 38*a*, 38*b* adapted to receive set screws 36a, 36b or any known means within the art to fixedly attach brush holder support 78 as more fully described below.

Referring to FIGS. 1 through 3, set screws 36*a*, 36*b* by which swing arm 40 is connected to upper section 30 of cradle 20 permits cradle 20 and the paint can to remain substantially upright under the influence of the weight of cradle 20, can and the paint therein since the center of gravity of this entire subassembly is below the pivot position of quick release coupling 50. Set screws 36*a*, 36*b* may be provided as rivets or any known means within the art.

As shown in FIG. 2 through FIG. 4, swing arm 40 is a circular shaped member having a plurality of apertures 44*a*, 44*b* adapted to receive screws 36*a*, 36*b* for urging swivel communication between swing arm 40 and upper section 30 of cradle 20. Swing arm 40 further has aperture 42 adapted to receive bolt 54. Quick release coupling 50 comprises male plug 52 and female connector 56 allowing swivel communication between waist belt 60 and swing arm 40. Male plug 52 is threadedly attached to swing arm 40 by nut screw. Female connector 56 is threadedly attached to waist belt 60 through aperture 62.

FIG. 4 shows brush holder 70 in fully retracted position. Brush holder 70 comprises first elongated member 72 and second elongated member 76. First elongated member 72 has an elongated slot 74 adapted to receive the handle of a paint brush. Brush holder 70 allows the painter to rest a wet brush in brush holder 70 when hands free control of the paint can and paint brush are needed. Second elongated member 76 is fixedly attached to first elongated member 72 with hinge 80, shown in FIG. 2. Second elongated member 76 comprises elongated slot 74 adapted to receive dowel 82 to allow slideable communication between brush holder 70 and middle section 26 of cradle 20. Brush holder support 78 allows slideable communication between brush holder 70 and upper section 30. As shown in FIG. 3, first elongated member 72 is horizontally oriented over the open paint container when brush holder 70 is in use.

Figure 5:
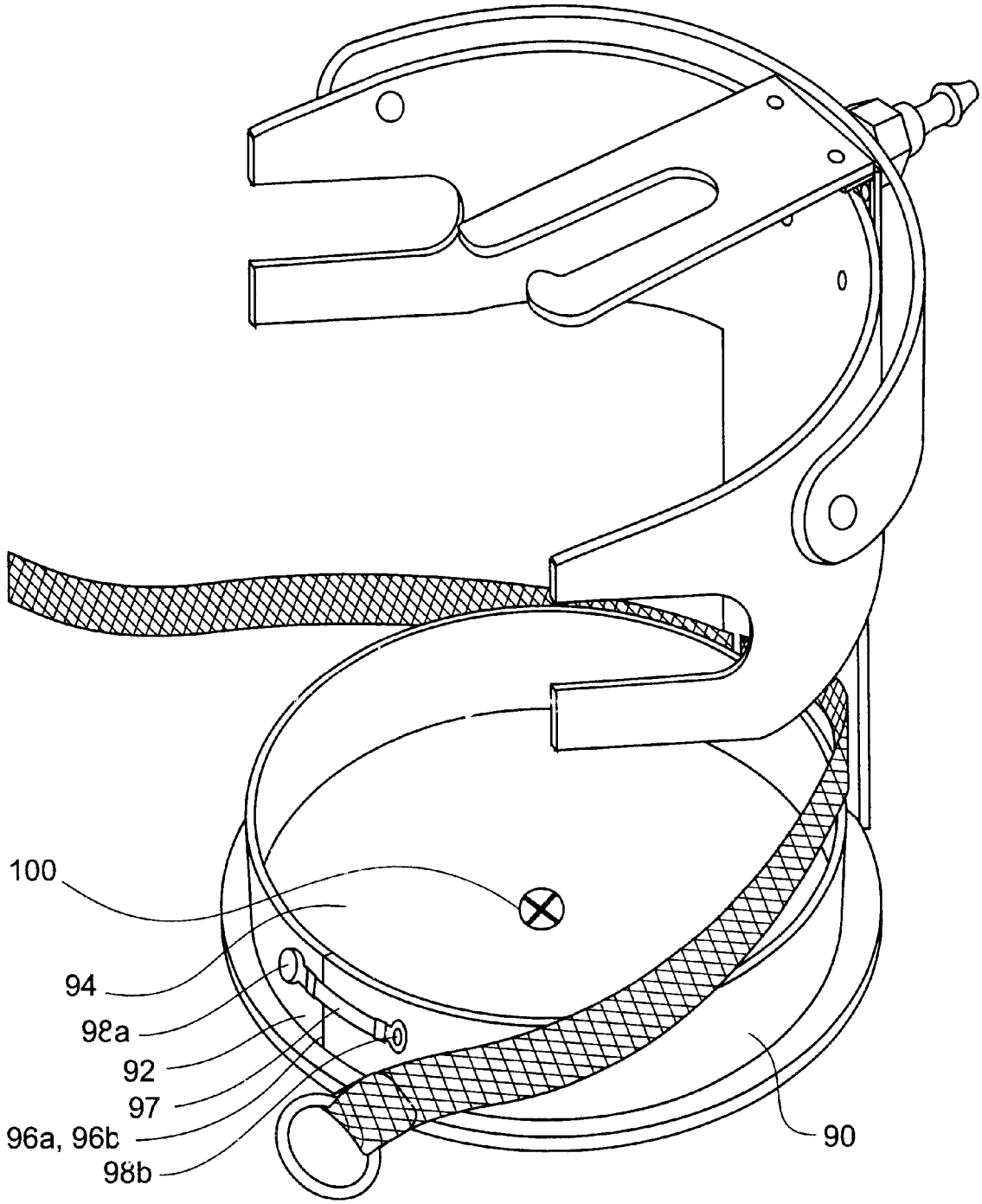
FIG. 5 is a perspective view of the present invention according to an alternate embodiment.
Figure 6:
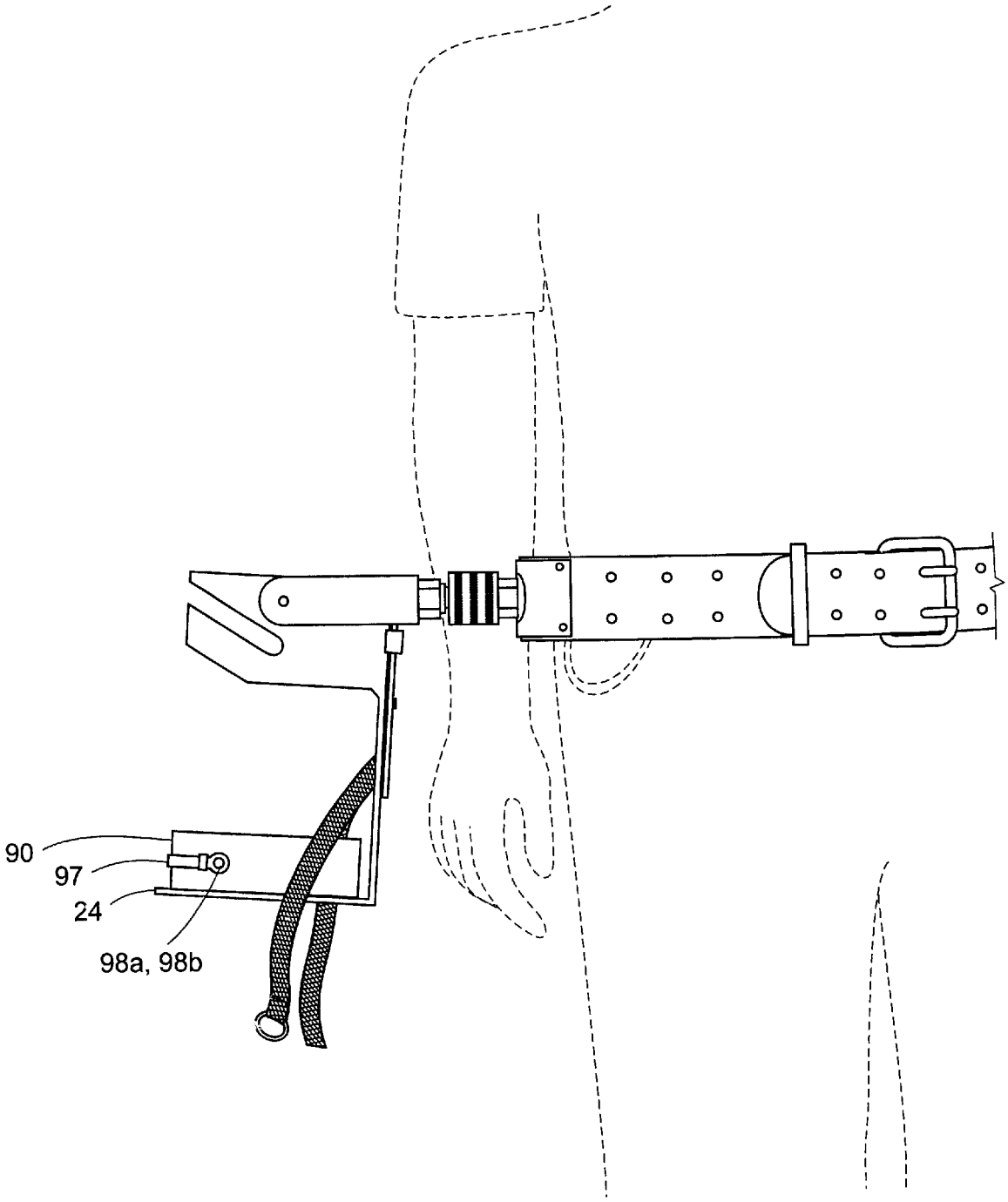
FIG. 6 is a perspective view of the present invention according to an alternate embodiment.

In an alternate embodiment, an adaptor 90 for a quart size paint can is shown in FIGS. 5 and 6. Adaptor 90 is a circular shaped cup defined by circular base 94 and wall 92. Adaptor 90 is attached to base 24 with bolt 100. A plurality of vertical slots 96*a*, 96*b* which allow wall 92 to expand slightly to accept a quart sized container. Strap 97 secured by hook and eye attachments 98*a*, 98*b* permit wall 92 to be tightened around container.

In use, paint can carrier 10 is donned by placing belt 60 about the waist and adjusting belt 60 to a comfortable tension. Cradle 20 is attached to waist belt 60 by sliding back female connector 56 and inserting male plug 52 thereto into the locked position. A paint container of chosen size is inserted into cradle 20 through opening and rests on base 24. The knoblike handle supports on the handle of the paint can are positioned into downwardly angled slots 34*a*, 34*b* in upper section 30 of cradle 20. Strap 28 is fastened around paint can to secure it tightly to cradle 20.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A paint can carrier for maintaining a paint can in a vertical orientation adapted for attachment to the person of a painter comprising:

a belt having means thereon for attachment to the person of the painter;

a swing arm having means for swivel attachment to said belt; and a vertically elongated cradle having a means thereon for supporting the paint can, said cradle adapted for swivel communication with said swing arm wherein said vertically elongated cradle swivels from said swing arm on one axis, said swing arm further swivels about said means for swivel attachment on another axis to provide movement of cradle on multiple axes to maintain cradle in a substantially upright vertical orientation at all times without regard to position of the person of the painter.

2. The paint can carrier of claim 1 wherein said vertically elongated cradle comprises a lower section, an upper section and a middle section therebetween wherein said lower section has means thereon for supporting the paint can.

3. The paint can carrier of claim 2 wherein said means for supporting the paint can comprises a horizontally disposed base.

4. The paint can carrier of claim 2 wherein the middle section comprises a strap for further supporting the paint can.

5. The paint can carrier of claim 1 wherein said means for swivel attachment is a quick release coupler having a connector and a plug, wherein said connector is attachable to said belt and said plug is attachable to said swing arm for urging swivel movement of said cradle for maintaining the paint can in a vertical orientation.

6. The paint can carrier of claim 5 wherein said belt further comprises an aperture for receiving said quick release coupler.

7. The paint can carrier of claim 3 further comprising an adaptor threadedly attached to said lower section of said vertically elongated cradle dimensioned to receive quart size or smaller paint can.

8. The paint can carrier of claim 7 wherein said adaptor comprises a cup shaped member having vertical slots with hook and eye attachments for tightening said adaptor about smaller sized paint can.

9. The paint can carrier of claim 1 further comprises a brush holder slideably attached to said cradle.

10. A paint can carrier for maintaining a paint can in a vertical orientation adapted for attachment to the person of a painter comprising:

a belt having means thereon for attachment to the person;

a quick release coupler having a connector and a plug, wherein said connector is attachable to said belt;

a swing arm having an aperture adapted to receive said plug of said quick release coupling; and a vertically elongated cradle having a lower section with a horizontally disposed base for supporting the paint can, an upper section adapted for swivel communication with said swing arm, and a middle section therebetween having a strap for keeping the paint can in a fixed position on said base;

wherein said vertically elongated cradle swivels from said swing arm on one axis, said swing arm further swivels about said quick release coupling on another axis to provide movement of said cradle on multiple axes to maintain said cradle in a substantially upright vertical orientation at all times without regard to position of the person of the painter.

11. The paint can carrier of claim 10 wherein said belt having aperture adapted to receive quick release coupling.

12. The paint can carrier of claim 10 further comprising an adaptor threadedly attached to said lower section of said vertically elongated cradle dimensioned to receive quart size or smaller paint can.

13. The paint can carrier of claim 12 wherein said adaptor comprises a cup shaped member having vertical slots with hook and eye attachments for tightening said adaptor about smaller sized paint can.

14. The paint can carrier of claim 10 further comprises a brush holder slideably attached to said cradle.

15. A paint can carrier for maintaining a paint can in a vertical orientation adapted for attachment to the person of a painter comprising:

a belt having clasping means thereon for attachment to the person;

a quick release coupler having a connector and a plug, wherein said connector is attachable to said belt;

an arcuate swing arm comprising a first aperture adapted to receive said male plug of said quick release coupling, further comprising a second aperture and a third aperture at opposite ends of said swing arm; and a vertically elongated cradle having a lower section with a horizontally disposed base for supporting the paint can, an arcuate upper section adapted for swivel communication with said opposite ends of said swing arm, and a middle section therebetween having a strap for keeping the paint can in a fixed position on said base;

wherein said vertically elongated cradle swivels from said swing arm on one axis, said swing arm further swivels about said quick release coupling on another axis to provide movement of said cradle on multiple axes to maintain said cradle in a substantially upright vertical orientation at all times without regard to position of the person of the painter.

16. The paint can carrier of claim 15 wherein said belt is adapted to receive said quick release coupling.

17. The paint can carrier of claim 15 further comprising an adaptor threadedly attached to said lower section of said vertically elongated cradle dimensioned to receive quart size or smaller paint can.

18. The paint can carrier of claim 17 wherein said adaptor comprises a cup shaped member having vertical slots with hook and eye attachments for tightening said adaptor about smaller sized paint can.

* * * * *